United States Patent [19]

Holl et al.

[11] Patent Number: 4,852,491

[45] Date of Patent: Aug. 1, 1989

[54] DEVICE FOR THE IN-REGISTER TRANSFER OF SHEETS BETWEEN THE PRINTING UNITS OF A MULTICOLOR PRESS

[75] Inventors: Roland Holl, Weiterstadt; Dietrich Dettinger, Heusenstamm, both of Fed. Rep. of Germany

[73] Assignee: M.A.N.-Roland Druckmaschinen, Offenbach am Main, Fed. Rep. of Germany

[21] Appl. No.: 114,215

[22] Filed: Oct. 28, 1987

[30] Foreign Application Priority Data

Oct. 28, 1986 [DE] Fed. Rep. of Germany ..... 3636578

[51] Int. Cl.[4] ..... B41F 21/00

[52] U.S. Cl. ..... 101/408; 101/232; 474/162; 271/267; 271/204

[58] Field of Search ..... 101/183, 232, 408, 409; 198/850, 851, 852, 853; 271/199, 204, 205, 206, 226, 267, 268; 474/153, 154, 155, 156, 157, 162, 226, 232

[56] References Cited

U.S. PATENT DOCUMENTS

| | | | |
|---|---|---|---|
| 3,389,657 | 6/1968 | Schwabach | 101/232 |
| 3,591,169 | 7/1971 | Preuss | 271/206 |
| 3,654,814 | 4/1972 | Richmond | 474/156 |
| 4,174,642 | 11/1979 | Martin et al. | 474/156 |
| 4,408,525 | 10/1983 | Rebel | 101/183 |
| 4,473,364 | 9/1984 | Roling | 474/155 |

FOREIGN PATENT DOCUMENTS

| | | | |
|---|---|---|---|
| 766896 | 10/1980 | U.S.S.R. | 101/232 |

*Primary Examiner*—David A. Wiecking

*Attorney, Agent, or Firm*—Leydig, Voit & Mayer

[57] ABSTRACT

A device the for in-register transfer of sheets and for the conveyance thereof between the printing units of a multi-color press by means of gripper carriages that move on rails and which are driven by an endless chain and which are aligned on the delivery and feed cylinders by rotating drive forks and that cooperate with a cam roller carried by the carriage. For joint axial and radial alignment with quiet entry the drive fork has leading and trailing flanks of different thicknesses and the flanks are guided into engagement with the cam roller by hardened guide plates in the gripper carriage. The leading flank is undersized and the second flank has the dimension necessary for establishing proper registration of the carriage.

2 Claims, 2 Drawing Sheets

DEVICE FOR THE IN-REGISTER TRANSFER OF SHEETS BETWEEN THE PRINTING UNITS OF A MULTICOLOR PRESS

DESCRIPTION OF THE INVENTION

The present invention relates generally to an arrangement for the in-register transfer and conveyance of sheets between the printing units of a multi-color lithographic press. More particularly, the invention relates to a sheet transfer and conveyance arrangement of the type having a receiving drum in the first printing unit, a feed drum in the second printing unit, each drum having an associated impression cylinder, an endless chain trained about the drums, a guide rail following the path of the chain, and a plurality of gripper carriages moveable on the rail and coupled to the chain for movement therewith.

Devices of this type are widely known and have been disclosed in, for example, U.S. Pat. No. 4,408,525. A disadvantage of devices of this type is the need for aligning the carriage, for example, by the registration of a tooth which enters a slot in the carriage, as set forth in Swiss patent CH-P483926, in order to position the carriage in proper axial register prior to sheet transfer. A particular problem is when the carriage is moving with significant misalignment, and hence, an abrupt re-positioning of the carriage is necessary to correct the deviation, which can create undesirable vibrations and cause wear.

It is an object of the present invention to provide an arrangement for the transfer and conveyance of sheets between first and second printing units of a multicolor lithographic printing press which has a drive fork adapted for more gradually moving gripper carriages into proper registration prior to sheet transfer.

Another object is to provide a sheet transfer and conveyance arrangement as characterized above in which the drive fork is operable for moving the carriage into proper axial registration in two distinct stages.

A further object is to provide a sheet transfer and conveyance arrangement of the above kind in which the drive fork first effects partial re-alignment of the gripper carriage and then axially, tangentially, and radially moves the carriage into final precise register for enabling reliable sheet transfer to the impression cylinder.

Yet another object is to provide a sheet transfer and conveyance arrangement of the foregoing type in which the two stage alignment of the carriages by the drive fork prevents backlash and corrects deviations in the carriage position in a relatively gentle and quiet manner.

These and other objects of the invention will become apparent upon reading the following detailed description and upon reference to the drawings, in which.

Figures 1, 4, 5:
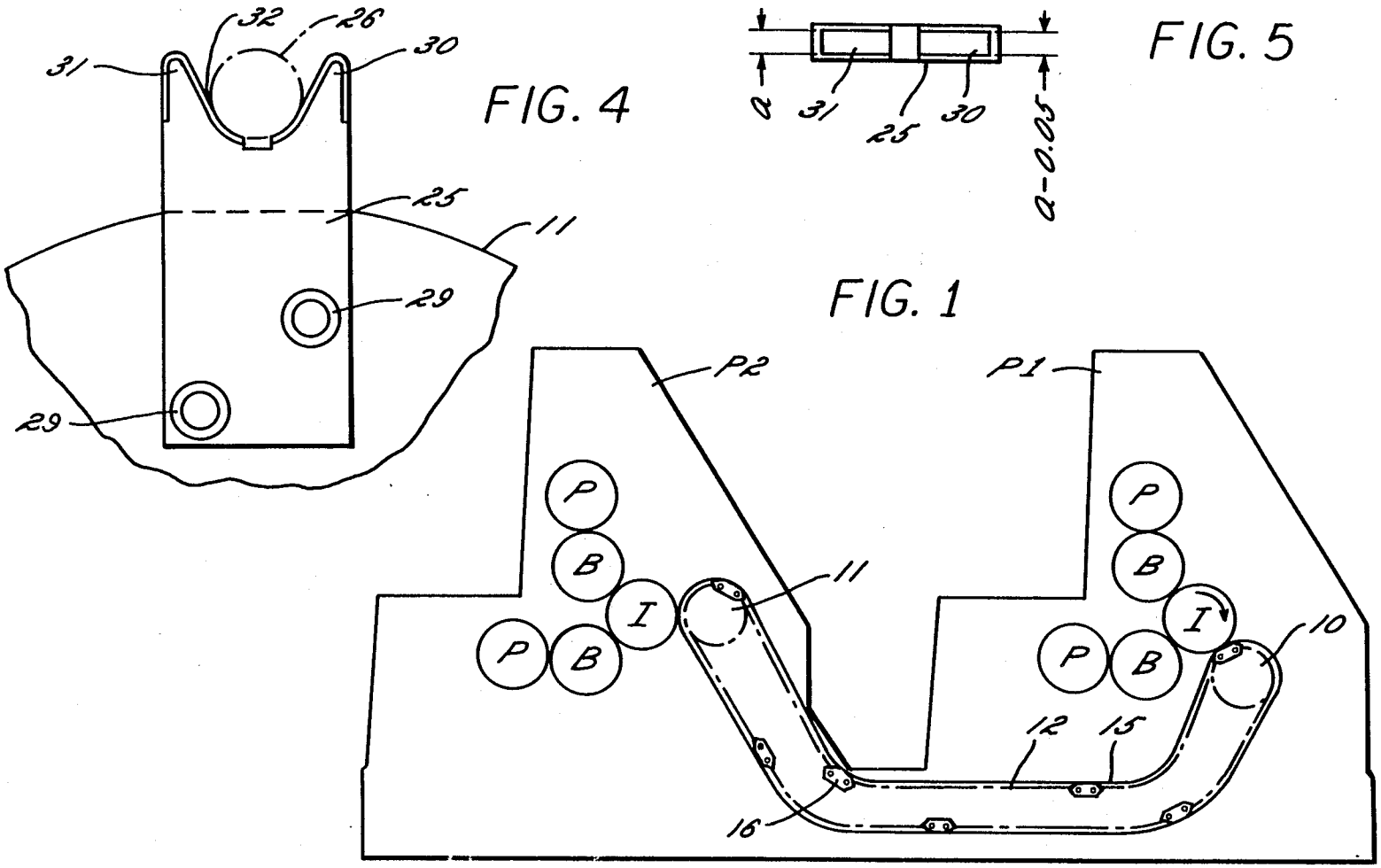
FIG. 1 is a diagrammatic elevation view of a typical multicolor lithographic printing press which includes a sheet transfer and conveyance arrangement in accordance with the present invention.
FIG. 4 is an enlarged view of the drum and drive fork.
FIG. 5 is an end view of the drive fork shown in FIG. 4.
Figure 2:
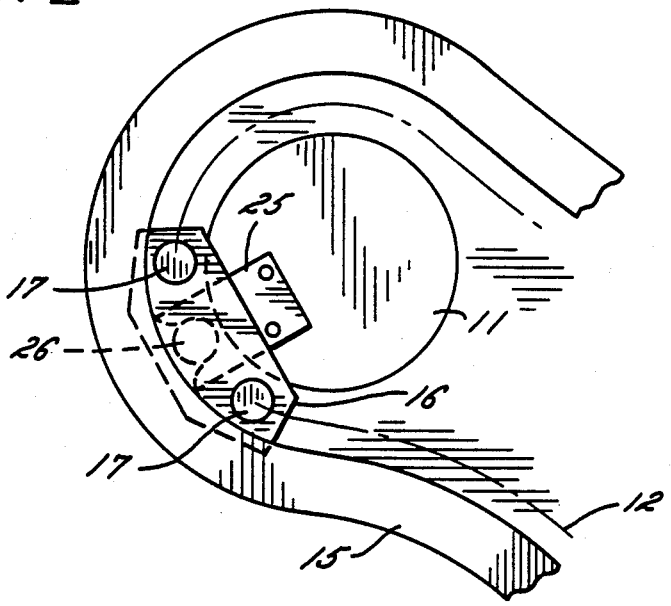
FIG. 2 is an enlarged fragmentary view of the chain and gripper carriage and the feed drum which drives it for the arrangement shown in FIG. 1.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Figure 3:
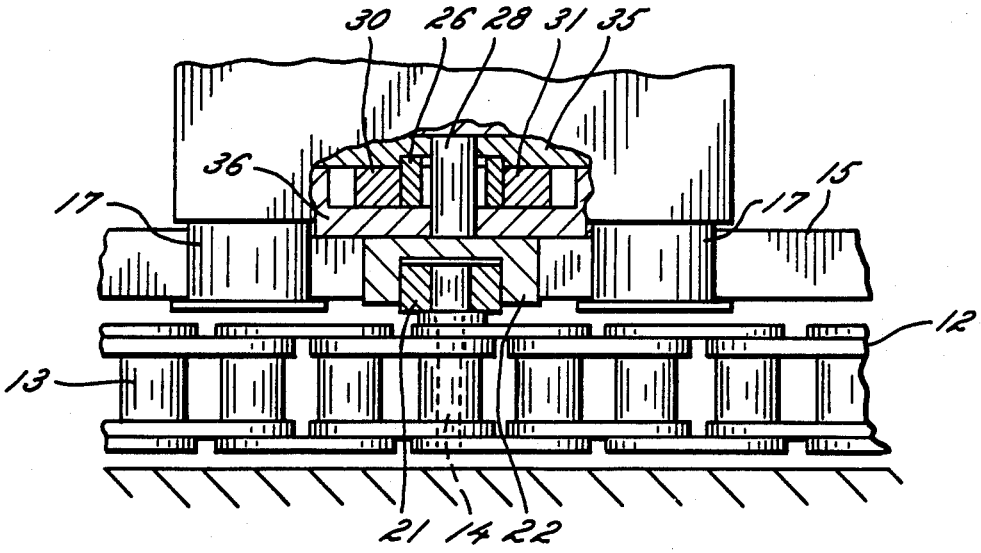
FIG. 3 is an enlarged fragmentary view, partially in section, of the drive according to the present invention acting on a gripper carriage.

Turning now to FIG. 1, there is shown a typical multi-color lithographic printing press which includes two printing units P1 and P2, respectively. Each printing unit includes two plate cylinders P offsetting onto a pair of blanket cylinders B which cooperate with a single impression cylinder I carrying a sheet (not shown) to which the printed impressions are applied in succession. A receiving drum 10 in the first printing unit is associated with the impression cylinder of that unit and a feed drum 11 in the second printing unit is associated with the impression cylinder in that unit. An endless chain 12 which includes links 13 (see FIG. 3) joined by pins 14 is trained about the drums and driven at "press speed" by appropriate drive means. A guide rail 15 follows the path of the chain for guiding gripper carriages 16 which are coupled to the chain for movement therewith. The carriages 16 each have a set of rollers 17 which engage the guide rail 15. Sheets (not shown) are conveyed seriatim from the impression cylinder I of the first printing unit P1 to the impression cylinder I of the second printing unit P2 by the chain via the gripper carriages 16, as is know to those skilled in the art.

For coupling each carriage 16 to the chain 12 for movement therewith, the chain has a drive roller 21 mounted outboard of one of the pins 14 of the chain. Each gripper carriage 16 has a yoke 22 rigidly secured to the body of the gripper carriage for snuggly embracing the drive roller 21 of the chain so that the carriage is coupled to the chain for movement therewith.

For engaging each gripper carriage 16 as it approaches a sheet transfer zone and for pressing the carriage outwardly so that the rollers 17 are pressed on the rail 15 without clearance or backlash, drive forks 25 are mounted to the respective feed drum 10, 11 in outwardly extending radial fashion for engaging a respective cam roller 26 on the carriage as the gripper carriage comes into the vicinity of the respective drum. The cam roller 26 in this case is mounted on a short cross shaft 28 secured to the carriage frame. The drive fork 25 is rigidly mounted to the drum by means of bolts 29 (FIG. 4) and rotates with the drum. As shown in FIG. 4, the drive fork 25 has an outwardly facing generally U-shaped recess which defines a pair of spaced leading and trailing flanks 30, 31, respectively, which in this instance have generally rounded ends. The leading flank 30 in this instance has a generally smooth entrance zone 32 to take up radial impacts, as will be apparent.

In accordance with the invention, the leading flank 30 has a slightly smaller dimensional width or thickness than the trailing flank 31 so that as a carriage comes into the vicinity of the drum the leading flank 30 will provide initial axial prealignment of the gripper carriage and then as the drive fork comes into full engagement with the cam roller the thicker trailing flank 31 will cause the carriage to be moved into relatively precise axial, tangential, and radial register. As shown in FIG.

5, the trailing flank 31 has a thickness of "a", while the leading flank 30 has a thickness of 0.05 millimeters less than that of the trailing flank.

In keeping with the invention, carriage slots on opposed sides of the cam roller 26 into which the flanks 30, 31 of the drive fork are respectively positionable are formed by a pair of hardened guide plates 35, 36. Since the flanks 30, 31 progressively bring the carriage into proper registration for sheet transfer, the final alignment and registration is effected without backlash, and more quietly and with less vibration than heretofore possible. The gradual, progressive alignment of the carriage further eliminates the necessity for abrupt corrections in carriage movement and the vibration and wear that can result from such abrupt redirectioning of the carriage.

We claim as our invention:

1. An arrangement for the transfer and conveyance of sheets between first and second printing units of a multicolor press comprising, in combination, a receiving drum in the first printing unit, a feed drum in the second printing unit having an associated impression cylinder, an endless chain trained about the drums, a stationary guide rail following the path of the chain, a plurality of gripper carriages movable with the chain, each carriage having a cam roller and means for defining slots on opposite sides thereof, said feed drum having a radially mounted drive fork for engaging said cam roller prior to sheet transfer, said drive fork being formed with an outwardly opening notch which defines a leading flank and a trailing flank, said leading and trailing flanges being successively engageable with said carriage slots on opposite sides of said cam roller as said drive fork engages cam roller, said leading flank having a thickness that is less than the thickness of the trailing flank so that upon engagement of said drive fork flanks with said carriage slots said leading flank moves the carriage into initial axial prealignment and the trailing flank thereupon causes the carriage to be moved into predetermined register for effecting sheet transfer.

2. The combination as claimed in claim 1 in which said means for defining slots on opposite sides of said cam roller comprises a pair of hardened metal guide plates mounted in the carriage in laterally spaced relation so as to form slots of widths corresponding substantially to the thicknesses of said leading and trailing flanks

* * * * *